US005918763A

United States Patent [19]

Hara et al.

[11] Patent Number: 5,918,763

[45] Date of Patent: Jul. 6, 1999

[54] ELECTRIC PART STORAGE CASING HAVING A RELEASABLE COVER WITH A DEFLECTABLE SIDE WALL

[75] Inventors: Yasuhiro Hara; Satoshi Saitou, both of Shizuoka, Japan

[73] Assignee: Yazaki Corporation, Tokyo, Japan

[21] Appl. No.: 08/813,902

[22] Filed: Mar. 7, 1997

[30] Foreign Application Priority Data

Mar. 8, 1996 [JP] Japan ..... 8-051925

[51] Int. Cl.[6] ..... B65D 39/00

[52] U.S. Cl. ..... 220/788; 174/66; 220/305; 220/784; 220/793; 220/326; 220/200; 229/129.19

[58] Field of Search ..... 220/DIG. 13, 788, 220/784, 793, 780, 4.21, 4.22, 4.23, 326, 305, 200, 260, FOR 100; 174/66, 67, 59, 101; 229/129.19

[56] References Cited

U.S. PATENT DOCUMENTS

| | | | |
|---|---|---|---|
| Re. 32,927 | 5/1989 | Taylor et al. | 220/780 |
| 2,658,664 | 11/1953 | Hennessey | 229/125.19 X |
| 3,176,900 | 4/1965 | Ciganenko | 229/125.19 |
| 3,351,227 | 11/1967 | Collie | 220/788 |
| 3,563,448 | 2/1971 | Croley | 229/23 BT |
| 3,966,082 | 6/1976 | Hopkins | 220/793 |
| 4,013,214 | 3/1977 | Hansen et al. | 220/4.21 |
| 4,034,884 | 7/1977 | White | 220/788 X |
| 4,431,114 | 2/1984 | Kleinfeld | 220/788 X |
| 4,687,096 | 8/1987 | Mansur | 220/788 X |
| 4,795,048 | 1/1989 | Trussardi | 220/4.21 |
| 4,795,056 | 1/1989 | Meyers | 220/788 |
| 5,467,887 | 11/1995 | Weaver | 229/125.19 X |
| 5,469,893 | 11/1995 | Caveney et al. | 174/101 X |
| 5,507,407 | 4/1996 | Feer et al. | 220/793 X |
| 5,624,051 | 4/1997 | Ahern, Jr. et al. | 220/793 X |

FOREIGN PATENT DOCUMENTS

| | | | |
|---|---|---|---|
| 3-130164 | 12/1991 | Japan . | |
| 5161261 | 6/1993 | Japan | 174/101 |
| 6-17325 | 3/1994 | Japan . | |

*Primary Examiner*—Stephen K. Cronin
*Assistant Examiner*—Robin A Hylton
*Attorney, Agent, or Firm*—Sughrue, Mion, Zinn, Macpeak & Seas, PLLC

[57] ABSTRACT

An electric parts storage casing is mounted on an electric junction box, and includes a storage casing body, and a cover engaged with this body. The cover includes a protruding portion which projects sidewise therefrom, and has an operating portion formed at a distal end thereof. Flexing portions are formed respectively at those portions of a peripheral wall of the cover respectively forming side corner portions of the protruding portion so that the cover can be smoothly and easily attached to and detached from the storage casing body merely by applying a lifting force to the operating portion.

7 Claims, 6 Drawing Sheets

ELECTRIC PART STORAGE CASING HAVING A RELEASABLE COVER WITH A DEFLECTABLE SIDE WALL

BACKGROUND OF THE INVENTION

1. Field of the Invention

This invention relates to a construction of releasing a cover of an electric parts storage casing wherein a storage casing body, which contains a number of electric parts arranged therein, and has a projecting portion projecting sidewise therefrom, is entirely covered with a cover from an upper side, the cover has a peripheral wall for surrounding an upper portion of an outer periphery of the body, engagement grooves are formed respectively in opposed side surfaces of the body, engagement projections are formed respectively on those of an inner side surface of the peripheral wall corresponding respectively to the engagement grooves, and the cover can be attached to the body by engaging the engagement projections respectively in the engagement grooves, and can be detached therefrom by disengaging the engagement projections respectively from the engagement grooves. This invention also relates to a construction of releasing a cover of an electric parts storage casing wherein a storage casing body of a substantially rectangular parallelepiped shape, which contains a number of electric parts arranged therein, is entirely covered with a cover from an upper side, the cover has a peripheral wall for surrounding an outer periphery of the body, engagement grooves are formed respectively in opposed side surfaces of the body, engagement projections are formed respectively on those of an inner side surface of the peripheral wall corresponding respectively to the engagement grooves, and the cover can be attached to the body by engaging the engagement projections respectively in the engagement grooves, and can be detached therefrom by disengaging the engagement projections respectively from the engagement grooves.

2. Description of the Related Art

As schematically shown in FIG. 7, an electric parts storage casing includes a cover 103 for covering electric function parts, such as a fuse and a relay, stored in a storage casing body 102 on an electric junction box 101, and engagement portions 102*a* are formed at side or peripheral walls of the storage casing body 102. The cover 103 has engagement portions 103*a* corresponding to the engagement portions 102*a*, respectively, and the cover 103 also has an operating portion 103*b* through which a force is applied to the cover 103 when removing the cover 103 from the storage casing body 102. FIGS. 8, 9 and 10 are a plan view, a side-elevational view and a cross-sectional view of the cover 103, respectively. FIGS. 11 and 12 are a plan view and a side-elevational view, showing the operation of the cover 103 when the cover 103 is released from the storage casing body 102. When a lifting force F is applied to the operating portion 103*b* so as to release the cover 103 from the storage casing body 102 (FIG. 12), the side wall of the cover 103, having the operating portion 103*b*, is flexed in directions of black arrows in FIG. 11, and is bulged to a position indicated by a dots-and-dash line, and as a result the engagement portion 103*a* is disengaged from the engagement portion 102*a* of the storage casing body 102.

However, in the cover 103, a large force is required for flexing this cover to the position indicated by the dots-and-dash line in FIG. 11. Therefore, the removal of the cover 103 from the storage casing body 102 can not be effected smoothly.

SUMMARY OF THE INVENTION

It is an object of this invention to provide a construction of releasing a cover of an electric parts storage casing in which the cover can be smoothly attached to and detached from a casing body of the electric parts storage casing.

To achieve the above object, the invention provides a construction of releasing a cover of an electric parts storage casing, comprising a storage casing body containing a number of electric parts arranged therein and having a projecting portion projecting sidewise therefrom, and a cover having a peripheral wall for surrounding an upper portion of an outer periphery of the storage casing body, wherein the storage casing body is entirely covered with the cover from an upper side, engagement grooves are formed respectively in opposed side surfaces of the body, engagement projections are formed respectively on an inner side surface of the peripheral wall of the cover corresponding respectively to the engagement grooves, and the cover is attached to the body by engaging the engagement projections respectively in the engagement grooves, and is detached therefrom by disengaging the engagement projections respectively from the engagement grooves, the cover comprising: a protruding portion for covering the projecting portion of the storage casing body, one of the engagement projections being formed on the inner side surface of the protruding portion and being engageable in one of the engagement grooves formed in the side surface of the projecting portion of the body; an operating portion formed on a distal end of the protruding portion for opening and closing the cover; and flexing portions formed respectively at portions of the peripheral wall respectively forming side corner portions of the protruding portion.

DETAILED DESCRIPTION OF THE PREFERRED EMBODIMENTS

Preferred embodiments of the invention will be described below in detail with reference to the accompanying drawings.

Figure 1:
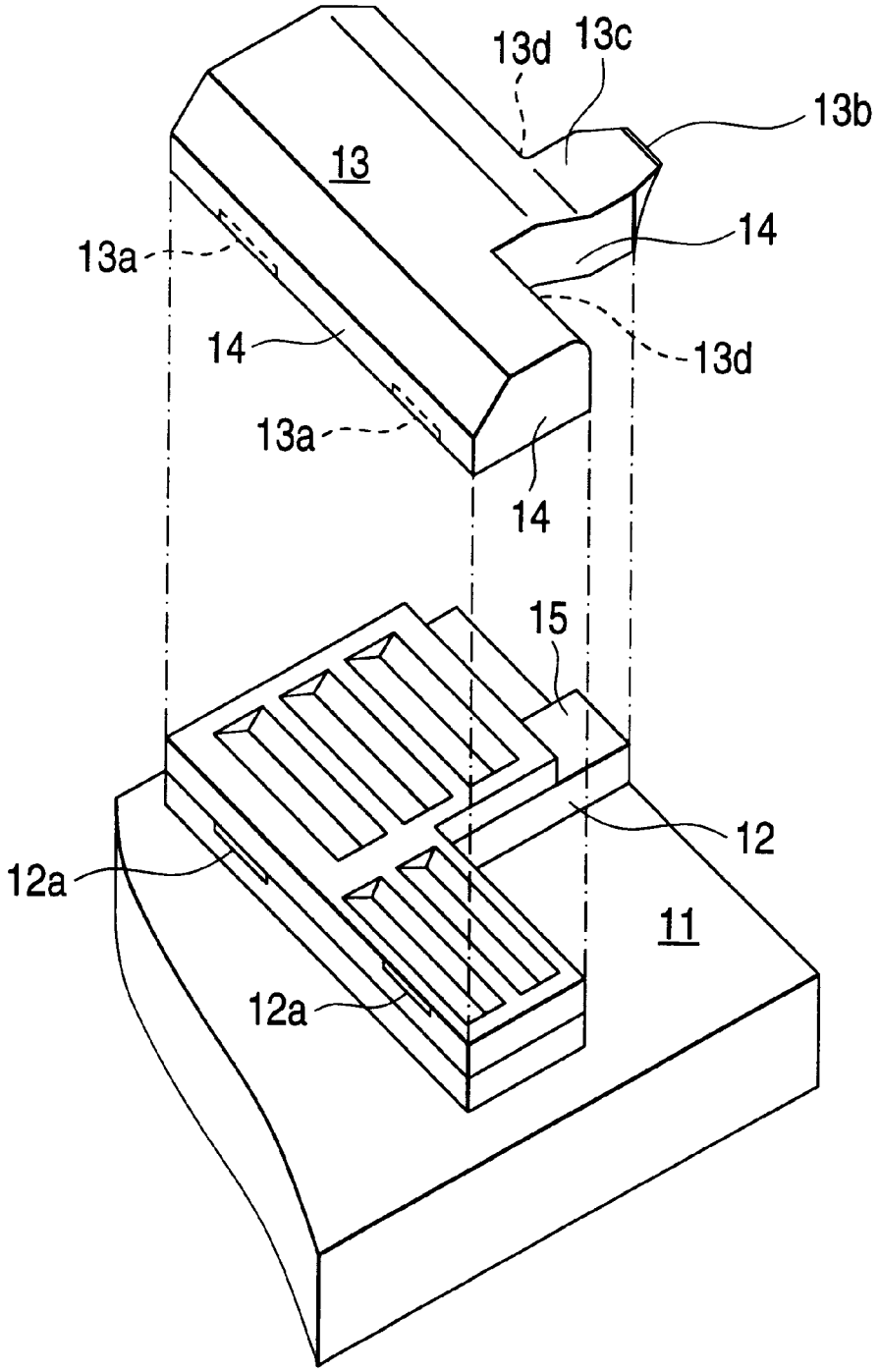
FIG. 1 is an exploded, perspective view showing an electric parts storage casing (mounted on an electric junction box) having a cover release construction of the invention.

One preferred embodiment of the invention will now be described with reference to FIGS. 1 to 5. FIG. 1 is a schematic, exploded perspective view showing an electric parts storage casing having a cover release construction of the invention, FIG. 2 is a cross-sectional view showing the reverse side of a cover as well as the storage casing for convenience' sake to clearly show an engaged condition, and FIG. 3 is a vertical cross-sectional view of the cover taken along the line A—A of FIG. 2.

Figure 2:
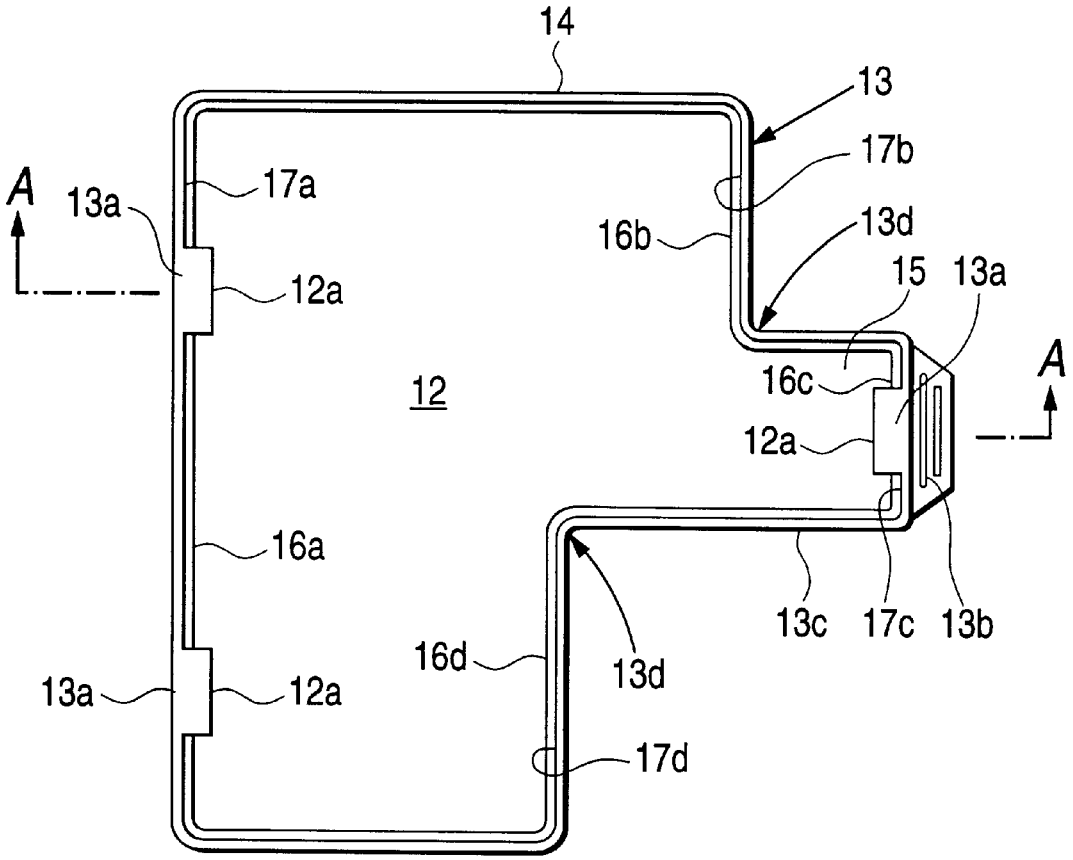
FIG. 2 is a cross-sectional view showing an important portion of the cover having the release construction of the invention.
Figure 3:
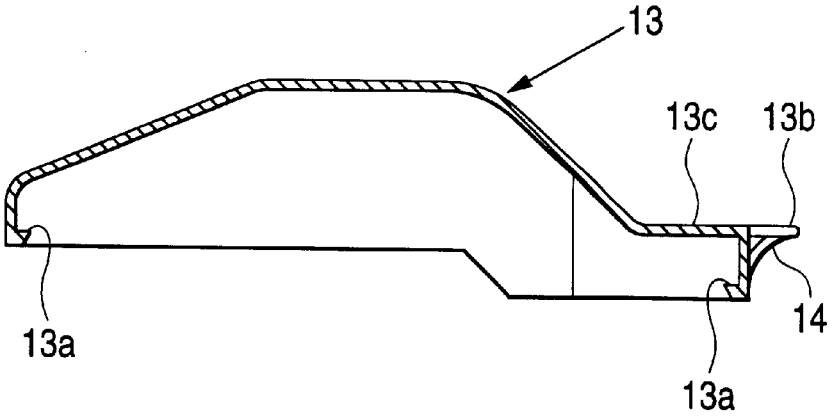
FIG. 3 is a vertical cross-sectional view of the cover taken along the line A—A of FIG. 2.

In FIGS. 1 and 2, the electric parts storage casing comprises a storage casing body 12 containing electric parts such as a fuse and a relay, and a cover 13, and this electric parts storage casing is placed on an electric junction box 11. The electric parts storage casing body 12 has a projecting portion 15 projecting sidewise. This casing body 12 has one opposing side surface 16*a*, and other opposing side surfaces 16*b*, 16*c* and 16*d* opposed to the opposing side surface 16*a*. Two engagement grooves 12*a* are formed in the opposing side surface 16*a*, and are spaced from each other, and an engagement groove 12*a* is also formed in the central one of the other opposing surfaces, that is, the opposing side surface 16*c*. In the illustrated embodiment, the side surface opposed to the opposing side surface 16*a* is divided into the three opposing side surfaces 16*b*, 16*c* and 16*d* which are parallel to the opposing side surface 16*a*, but are spaced different distances from the opposing side surface 16*a*.

The cover 13 covers the whole of the storage casing, and includes a peripheral wall 14 surrounding an upper portion of the outer periphery of the storage casing body 12, and engagement projections 13*a*, which are engageable respectively in the engagement grooves 12*a* in the storage casing body 12, are formed on inner surfaces 17*a* and 17*c* of the peripheral wall 14, as shown in FIG. 2. That portion of the peripheral wall 14 corresponding to the other opposing side surfaces is bent perpendicularly (right-angularly) at two portions to provide two flexing portions 13*d*, and a protruding portion 13*c* for covering the projecting portion 15 of the casing body 12 is formed integrally with the peripheral wall 14, and is formed at a central portion between the two flexing portions 13*d*. Therefore, the flexing portions 13*d* define opposite side corner portions of the protruding portion 13*c*, respectively. The protruding portion 13*c* has an integral, thumbpiece-like operating portion 13*b* which is formed at its outer end, but is spaced from that portion of the peripheral wall 14 having the engagement projection 13*a*.

Figure 4:
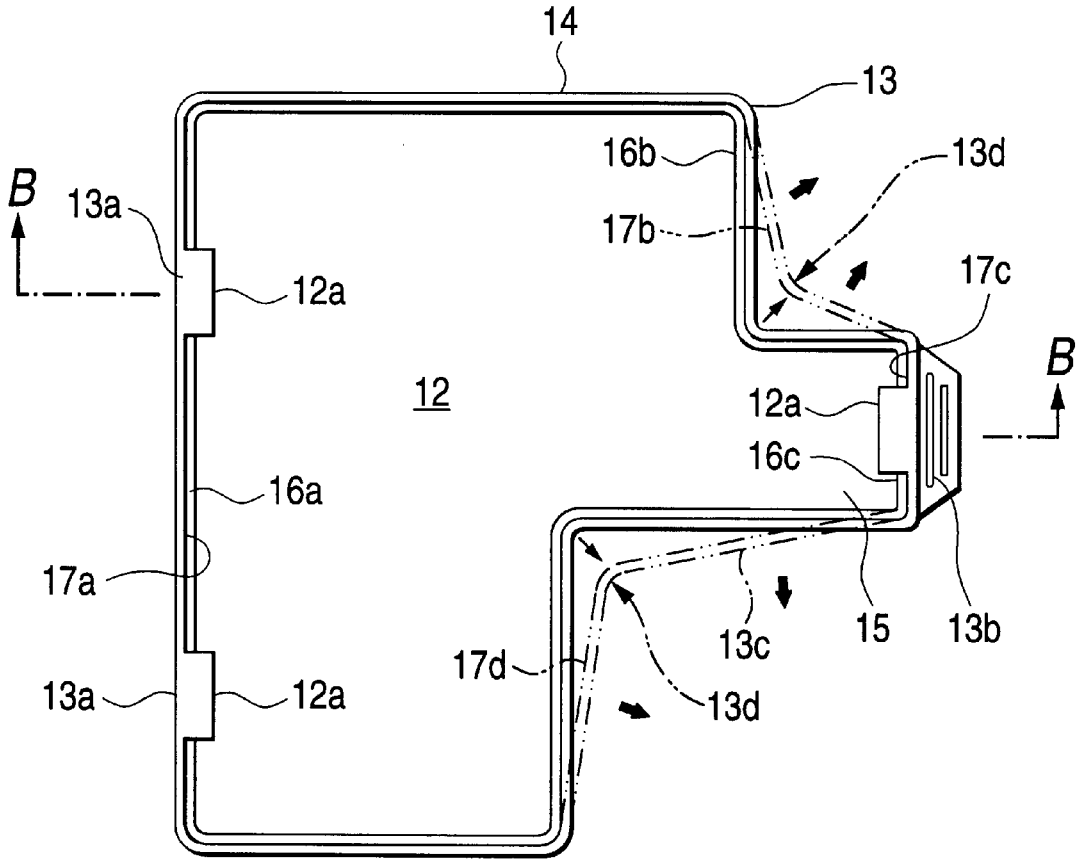
FIG. 4 is a cross-sectional view similar to FIG. 2, showing the operation for removing the cover from a storage casing body.

As shown in FIGS. 2 and 4 which are the cross-sectional views, an inner side surface of that portion of the peripheral wall 14 corresponding to the other opposing side surfaces 16*b* to 16*d* of the storage casing body 12 is divided into three portions 17*b*, 17*c* and 17*d*, which are disposed in parallel, opposed relation to an inner side surface 17*a* of the peripheral wall 14 corresponding to the opposing side surface 16*a*. However, the inner peripheral surface of the peripheral wall 14 except that portion corresponding to the central protruding portion 13*c* does not always need to be parallel to the inner side surface 17*a*. In this embodiment, although the opposing side surfaces 16*b* and 16*d* are disposed in staggered relation to each other, these surfaces 16*b* and 16*d* may be spaced equidistant from the surface 16*a*, and may be disposed in a common plane. However, it is important that the central inner side surface 17*c* of the peripheral wall 14 should be the remotest from the inner side surface 17*a* of the peripheral wall 14 in parallel relation thereto.

Figure 5:
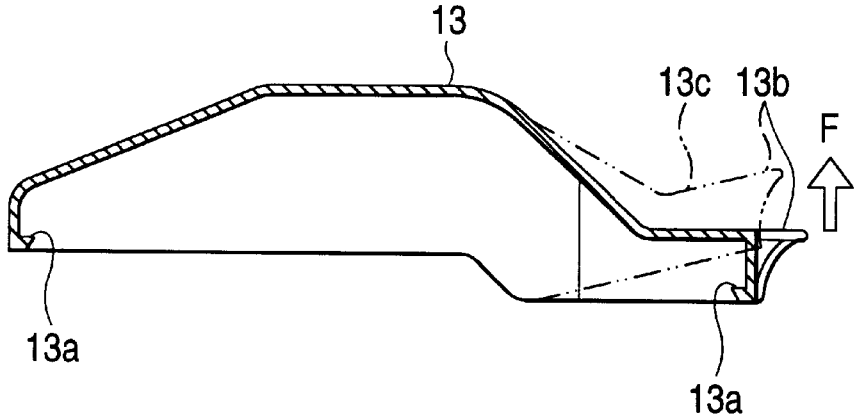
FIG. 5 is a vertical cross-sectional view of the cover taken along the line B—B of FIG. 4.

As shown in FIGS. 4 and 5, as described above, the two flexing portions 13*d* delimit the protruding portion 13*c* of the cover 13, and also divide the relevant portion into the three inner side surfaces 17*b*, 17*c* and 17*d*. Further, when the finger is brought into engagement with the operating portion 13*b*, and a lifting force F is applied to the operating portion 13*b* as indicated by a white arrow in FIG. 5, the protruding portion 13*c* is bent independently of the remainder of the cover 13 at a bending line (not shown) interconnecting the central portions of the two flexing portions 13*d*. At this time, the flexing portions 13*d* are expanded from the right-angular condition of use in directions of black arrows as shown in dots-and-dash lines (since each flexing portion 13*d* has such a configuration as to achieve no-load flexing at its lower end), and at the same time those portions of the peripheral wall 14 adjacent to the flexing portion 13*c* are also expanded at their lower side. Therefore, the engagement projection 13*a*, formed on the inner side surface 17*c* of the protruding portion 13*c*, slightly moves outward along a slanting surface of the engagement groove 12*a* formed in the storage casing body, and then substantially moves upward, and therefore the engaged condition can be released quite easily. The inner side surface 17*c* of the peripheral wall of the cover can easily be elastically moved outward and upward by a slight lifting force applied to the operating portion 13*b*.

Clearly, for increasing the elasticity or flexibility of the flexing portions 13*d*, it is effective that those portions of the peripheral wall 14 having these flexing portions 13*d* be formed into a smaller thickness than the remainder, and this can be achieved by a method of forming the cover into an integral construction, using a thermoplastic resin.

Figure 6:
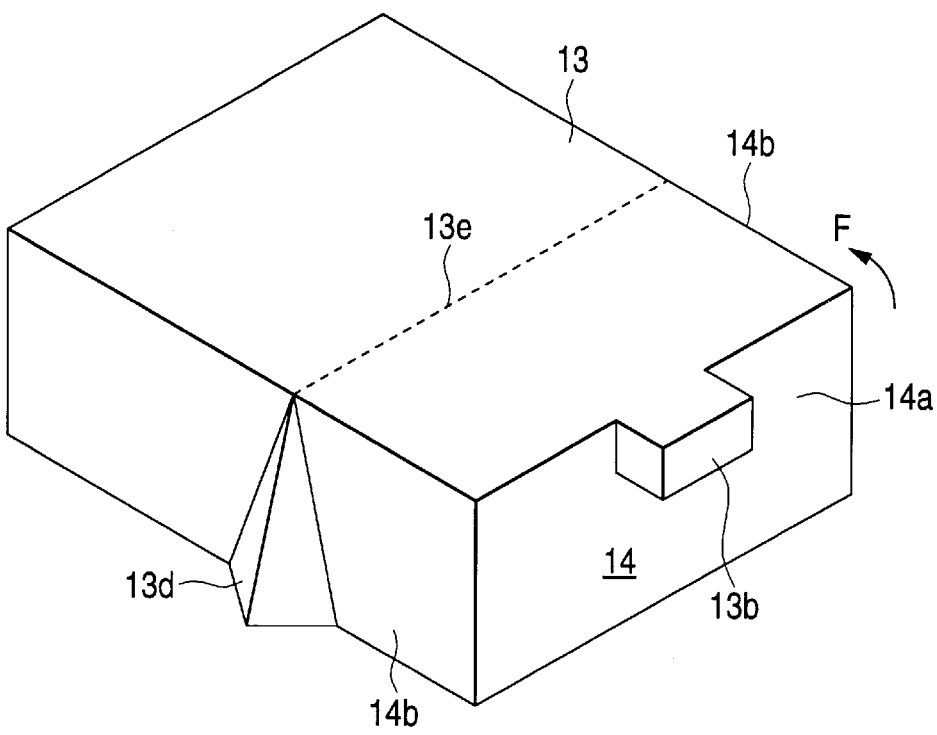
FIG. 6 is a perspective view showing only a cover having a cover release construction of another embodiment.
Figure 7:
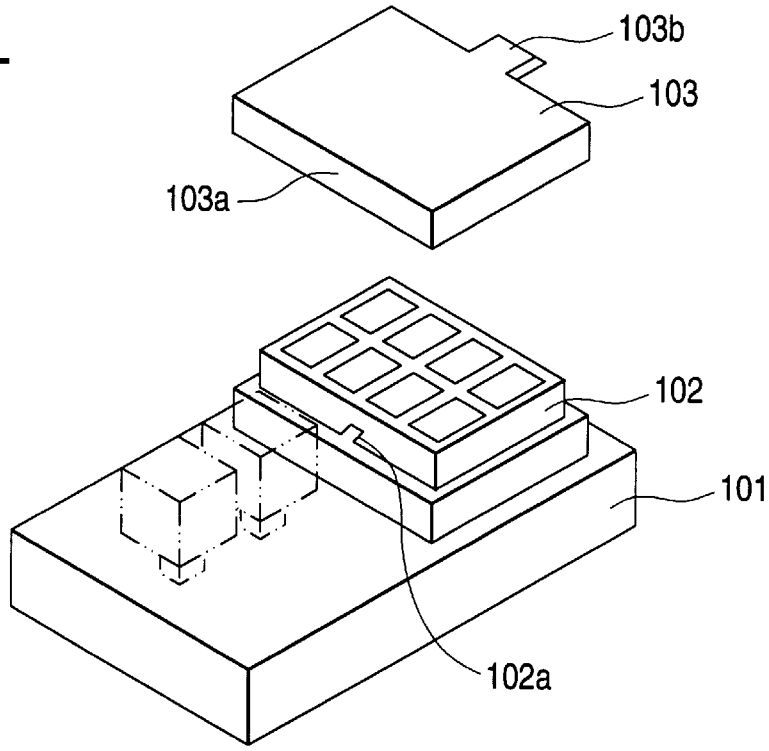
FIG. 7 PRIOR ART
FIG. 7 is a perspective view of an electric parts storage casing (mounted on an electric junction box) having a conventional cover release construction.
Figure 8:
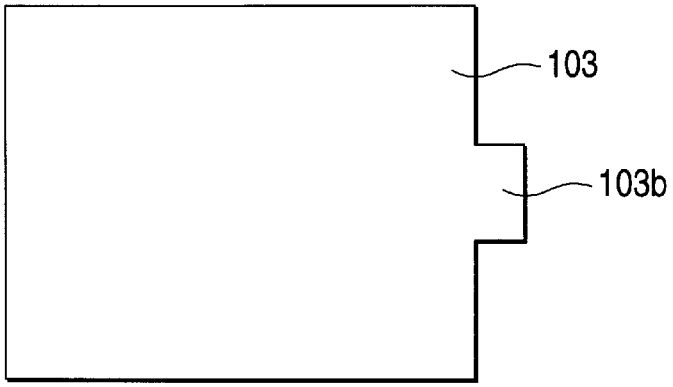
FIG. 8 PRIOR ART
FIG. 8 is a plan view showing only the cover of FIG. 7.
Figure 9:
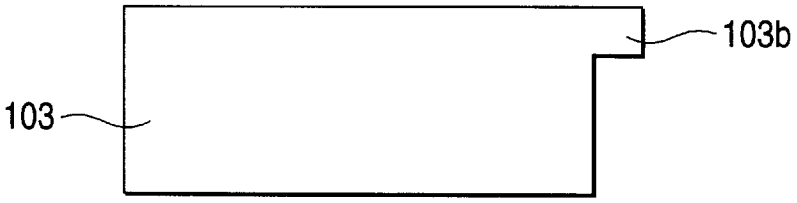
FIG. 9 PRIOR ART
FIG. 9 is a side-elevational view of the cover of FIG. 8.
Figure 10:
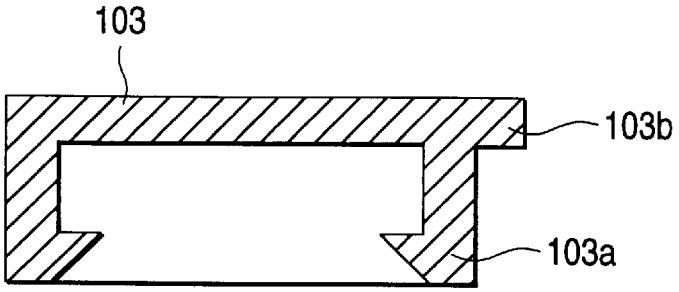
FIG. 10 PRIOR ART
FIG. 10 is a cross-sectional view of the cover of FIG. 9.
Figure 11:
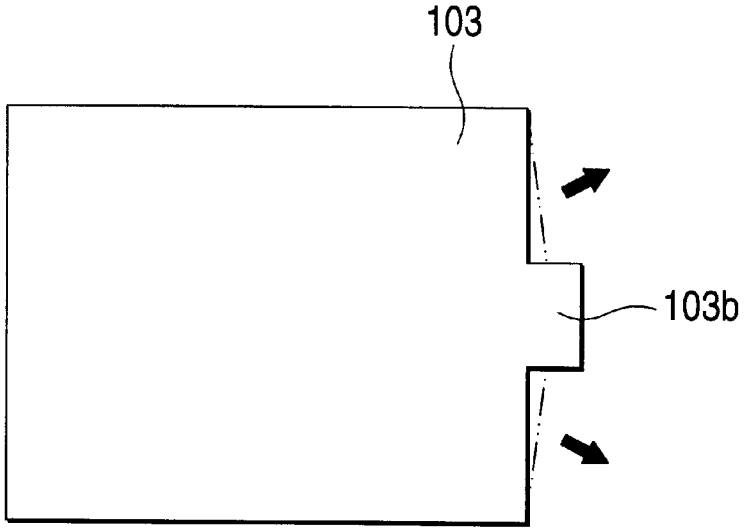
FIG. 11 PRIOR ART
FIG. 11 is a plan view similar to FIG. 8, but showing the operation of the cover when removing the cover from a storage casing body.
Figure 12:
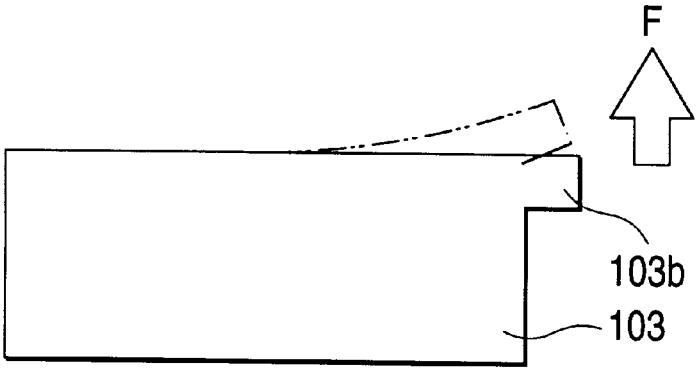
FIG. 12 PRIOR ART
FIG. 12 is a side-elevational view of the cover of FIG. 11.

FIG. 6 is a schematic, perspective view of another embodiment of a cover release construction for an electric parts storage casing of the invention. Although the showing of a storage casing, corresponding to the storage casing 12 of the preceding embodiment, is omitted, this storage casing has a rectangular parallelepiped shape, and only a cover 13 for covering the storage casing is shown. An operating portion 13*b* for opening and closing the cover is formed on a front side 14*a* of a peripheral wall 14 of the cover 13 at an upper edge thereof, and projects horizontally therefrom.

Although those portions corresponding to the engagement grooves 12*a* formed in the storage casing body of the embodiment shown in FIGS. 1 to 5, as well as those portions corresponding to the engagement projections 13*a* formed on the opposed inner side surfaces 17*a* and 17*c* of the peripheral wall of the cover 13 for engagement in the respective engagement grooves 12*a*, are not shown in this embodiment, it will be readily appreciated that similar engagement grooves and engagement projections are provided between the front side 14*a* of the peripheral wall 14 and a rear side thereof opposed to the front side 14*a*.

Flexing portions 13*d*, corresponding to the flexing portions 13*d* of the preceding embodiment, are provided respectively on opposite side walls 14*b* of the peripheral wall 14 disposed respectively on opposite sides of the front side 14*a*, and these flexing portions 13*d* are disposed substantially vertically. The two flexing portions 13*d* are spaced an equal distance from the opposite ends of the front side 4*a*, respectively, and each of the flexing portions 13*d* is formed by a pleat of a substantially triangular pyramid-shape projecting outwardly progressively from an upper edge of the side wall 14*b* to a lower edge thereof. More specifically, when viewed from the top, outwardly-inclined, generally-vertical, straight ridges of the two flexing portions 13*d* and a bending line 13*e* of the cover 13 lie on a straight line. With this configuration, when the operating portion 13*b* is lifted substantially arcuately in a direction of arrow F, lower portions of the flexing portions 13*d* are expanded, and when the flexing portions 13*d* are displaced into their respective maximum expanded positions, their ridges are disposed respectively in planes in which the opposite side walls 14*b* lie, respectively.

Because of the effect of the pleats forming the respective flexing portions 13*d*, the cover can be opened and closed with a very slight external force, and therefore the cover can be quite easily attached to and detached from the storage casing body. The above construction substantially means that one end portion of the cover is hingedly connected, and this construction is suited particularly for the case where the cover is frequently opened and closed.

The cover release construction of the electric parts storage casing of the invention has the above-mentioned construction, and therefore because of the effect of the flexing portions of the cover, the cover can be easily opened and closed with a small force applied to the operating portion. Therefore, the cover can be easily disengaged from the storage casing body, and therefore advantageously, the cover can be smoothly attached to and detached from the storage casing body. Besides, there is no need to apply an undue force when attaching and detaching the cover relative to the storage casing, and therefore the two members are durable for a long period of time, and are free from damage even if the cover is operated frequently.

What is claimed is:

1. An electric parts storage casing comprising:

a storage casing body having a side wall with a first side wall section opposite to a second side wall section, said first side wall section having a projecting portion that projects laterally and outwardly therefrom;

a plurality of engagement grooves formed in said first and said second side wall sections, one of which is formed in said projecting portion of said first side wall section;

a cover having a peripheral wall with an inner surface for surrounding said side wall of said storage casing body, said peripheral wall having a protruding portion for surrounding said projecting portion of said first side wall section of said storage casing body, said protruding portion having a flexing portion at a base thereof;

a plurality of engagement projections formed on said inner surface of said peripheral wall corresponding respectively to said plurality of engagement grooves, one of which is formed on said protruding portion of said peripheral wall, said cover being attachable to said storage casing body by engaging said plurality of engagement projections respectively in said plurality of engagement grooves, and being detachable therefrom by disengaging said plurality of engagement projections respectively from said plurality of engagement grooves;

an operating portion formed on said protruding portion of said peripheral wall;

wherein, when said cover is attached to said storage casing body, applying an upward force to said operating portion laterally displaces said flexing portion away from said projecting portion, such that said one of said plurality of engagement projections formed on said protruding portion of said peripheral wall disengages from said one of said plurality of engagement grooves formed in said projecting portion of said first side wall section.

2. An electric parts storage casing according to claim 1, wherein, when said cover is attached to said storage casing body, said inner surface of said peripheral wall of said cover abuts said side wall along an entire periphery of said storage casing body.

3. The electric parts storage casing according to claim 1, wherein said peripheral wall is bent at a right angle at portions thereof forming said flexing portion.

4. The electric parts storage casing according to claim 1, wherein said flexing portion is smaller in thickness than a remainder of said peripheral wall.

5. The electric parts storage casing according to claim 1, wherein said protruding portion of said peripheral wall is delimited by two flexing portions disposed respectively at opposite sides thereof, and said first side wall section of said storage casing body is divided into three sections which oppose said second side wall section.

6. The electric parts storage casing according to claim 5, wherein said inner surface of said peripheral wall at said protruding portion is parallel to and spaced farther from said second side wall section of said storage casing body than any other part of said peripheral wall.

7. The electric parts storage casing according to claim 5, wherein two inner side surfaces of said peripheral wall adjacent to said protruding portion are spaced different distances from said second side wall section, and are parallel thereto.

* * * * *